United States Patent [19]

Walker

[11] 4,015,420

[45] Apr. 5, 1977

[54] BATTERY SELECT CIRCUITRY AND LEVEL TRANSLATOR FOR A DIGITAL WATCH

[75] Inventor: Dennis E. Walker, Costa Mesa, Calif.

[73] Assignee: Hughes Aircraft Company, Culver City, Calif.

[22] Filed: May 3, 1976

[21] Appl. No.: 682,431

[52] U.S. Cl. ..... 58/23 BA; 58/50 R

[51] Int. Cl.[2] ..... G04C 3/00

[58] Field of Search ..... 58/23 R, 23 A, 50 R; 340/248 A, 249

[56] References Cited

UNITED STATES PATENTS 3,968,641 7/1976 Moyer ..... 58/50 R

*Primary Examiner*—Robert K. Schaefer
*Assistant Examiner*—Vit W. Miska
*Attorney, Agent, or Firm*—F. I. Konzem; W. H. MacAllister

[57] ABSTRACT

A battery select circuit and level translator in a digital watch; the battery select circuit uses the voltage from a single battery to power a digital watch's oscillator and high frequency dividers and uses the voltage from two batteries when the watch user desires the watch's horological information to be displayed on the display devices. Also, when only the voltage of a single battery is required, i.e., to power the digital watch's oscillator and high frequency dividers, the power switch causes the voltage from a first battery to be used during the 12 hour A. M. period and then switches to use the voltage from a second battery during the 12 hour P. M. period; thereby causing both batteries to wear out at the same rate.

The level translator which includes level shifters shifts or extends the voltage from the oscillator and high frequency dividers to a higher voltage level to clock the low frequency watch logic.

5 Claims, 3 Drawing Figures

BATTERY SELECT CIRCUITRY AND LEVEL TRANSLATOR FOR A DIGITAL WATCH

BACKGROUND OF THE INVENTION

1. Field of the Invention

This invention relates to digital electronic watches, and more particularly to a digital watch having battery select circuitry which connects the first battery to the digital watch's oscillator and high frequency dividers to power same during the A.M. period and connects a second battery to the digital watch's oscillator and high frequency dividers during the P.M. period and connects both batteries to the digital watch's oscillator and high frequency dividers when the user of the watch desires to display the horological information.

2. Description of the Prior Art

In the art, the LED digital watch and the Liquid Crystal Display digital watch with an illumination light have employed two batteries (each supplying 1.5 volts) to power said watch's oscillators and electronic circuitry. Use of two batteries wasted power, i.e., only one battery, 1.5 volts, was needed to power the watch's oscillator and electronic circuitry when the LED display elements were not illuminated. These prior art digital watches were using two batteries to supply the voltage to the oscillator and electronic circuitry all of the time when the voltage from only one battery would have been sufficient. One solution to this problem was described in patent application Ser. No. 576,760 filed May 12, 1975, entitled, "Digital Watch with Oscillator/Divider Power Selection Circuitry," by Norman E. Moyer. The "Power Selection Circuitry" as described in Ser. No. 576,760 powers the digital watch's oscillator and electronic circuitry with one particular battery and then when the display is interrogated both batteries are used. The drawback with this invention is that it wore out the one particular battery that was being used all the time to power the oscillator and the electronic circuitry of the digital watch. That is, one battery was constantly being used and therefore wore out much sooner than the other battery. The present invention solves this problem by switching the batteries; the first battery is used to power the oscillator and high frequency dividers during the A.M. period and the second battery is used to power the oscillator and electronic circuitry during the P.M. period, naturally if the user interrogates the horological information during either period both batteries will be used to power the oscillator and high frequency dividers because one battery when under load cannot supply enough voltage to operate the oscillator and high frequency dividers.

SUMMARY OF THE INVENTION

The battery select circuitry and level translator in a digital watch, in accordance with the invention, consists of a plurality of logic gates. The logic gates connect a first battery to power the digital watch's oscillator and high frequency dividers during the 12 hour A.M. period and connect a second battery to the digital watch's oscillator and high frequency dividers during the 12 hour P.M. period. The battery select circuitry also consists of level shifters which extend the voltage from the oscillator and high frequency dividers to a higher voltage level to clock the low frequency watch logic.

Accordingly, it is an object of this invention to provide battery select circuitry in a digital watch which selects a first battery to power the digital watch's oscillator and high frequency dividers during the A.M. period, selects the second battery to power the digital watch's oscillator and high frequency dividers during the P.M. period and selects both the first and second batteries to power the digital watch's oscillator and high frequency dividers when the horological information is interrogated by the user.

It is a further object to provide the battery select circuit which uses only one battery to power the digital watch's oscillator and high frequency dividers when the display elements are not activated and which uses two batteries to power the oscillator and high frequency dividers when said display elements are activated.

Finally, it is an object to provide a battery select which increases the life of the batteries and wears out the two batteries at the same rate.

The features of the present invention which are believed to be novel are set forth with particularity in the appended claims. The present invention, both as to its organization in manner of operation, together with further objects and advantages thereof, may be understood best by reference to the following description, taken in connection with the accompanying drawings.

A BRIEF DESCRIPTION OF THE DRAWINGS

DETAILED DESCRIPTION

Figure 1:
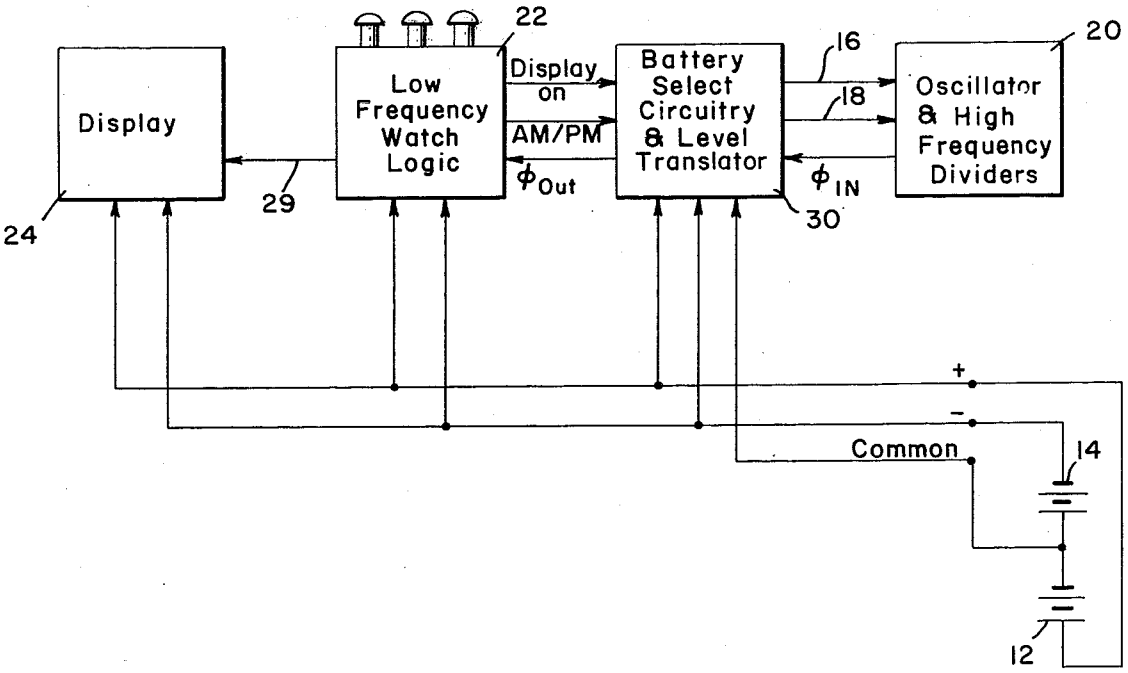
FIG. 1 is a block diagram of the battery select circuitry and level translator of the present invention in a digital watch.

Referring now to FIG. 1, the voltage from the series connected batteries 12 and 14 is routed through the battery select circuitry outputs 16 and 18, which are connected to and power the digital watch's oscillator and the high frequency dividers 20. Input 26 to the battery select circuitry 30 is connected to the A.M./P.M. signal from the digital watch's low frequency logic 22. For example, a high binary level signal would be delivered from logic 22 via input 26 during the 12 hour A.M. period and a low binary signal would be delivered to the battery select circuitry 30 via input 26 during the P.M. period. (Naturally, this example is arbitrary and the high level binary signal could be present during the P.M. period and the low binary level signal could be present during the A.M. period).

Several push buttons are connected to the low frequency watch logic 22 which generates the "DISPLAY ON" signal via line 28 to the battery select circuitry 30. When the user desires for the watch's horological information to be displayed on the display devices 24 he depresses the push button, thereby sending a high binary level signal via line 28 to the battery select circuitry 30, thereby causing the voltage from both batteries 12 and 14 to be delivered to the oscillator high frequency dividers 20, the low frequency logic 22 and to the display devices 24. The other push buttons are used for obtaining different horological information and for setting the time. Output 29 from low frequency logic 22 determines which display segments of the display devices 24 will be activated.

In operation, if the P.M. signal is present, the push button is not depressed and there is a delta voltage ($\Delta V$) potential of 1½ volts between the battery select circuitry outputs 16 and 18, thereby delivering 1½ volts (from one battery) to the digital watch's oscillator and the high frequency dividers 20. The 1½ volts is a sufficient voltage to power the oscillator and the high frequency dividers 20. But, when an A.M. signal is present on input 26, the push button is not depressed and the voltage potential (ΔV) between outputs 16 and 18 (from the second battery) is 1½ volts. Finally when a P.M. signal is present on input 26, the user has depressed the push button and a high binary level signal is present on input 28, thereby causing the voltage potential between outputs 16 and 18 to be 3 volts thereby supplying 3 volts to oscillator high frequency dividers 20.

Figure 2:
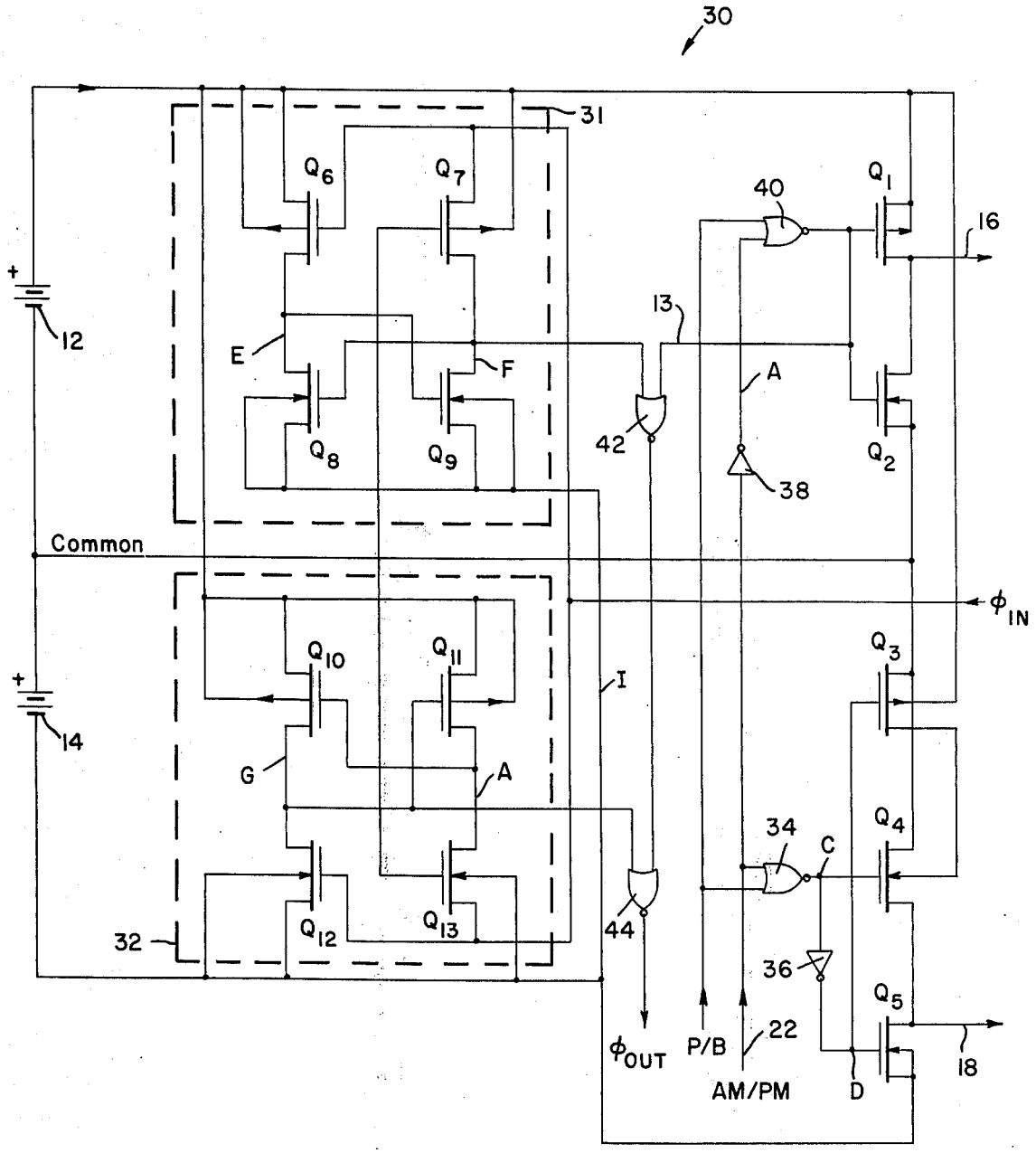
FIG. 2 is a schematic drawing of the battery select circuitry and level translator.

FIG. 2 is a schematic of the battery select circuitry and level translator 30, which includes a first battery 12, the positive terminal being connected to battery select circuitry and level translator 30, to the low frequency watch logic 22 and to the display 24. The negative terminal of battery 12 is connected to common and to battery 14. The positive terminal of the second battery 14 is connected to the common line and its negative terminal is connected to battery select circuitry and level translator 30, to the low frequency watch logic 22 and to the display 24.

The level translator 30 consists of level shifters 31 and 32 which are of an identical configuration; level shifter 31 consisting of MOSFETS Q6, Q7, Q8, Q9 and a level shifter 32 consisting of MOSFETS Q10, Q11, Q12, Q13. In level shifter 31, MOSFET Q6 is a p-channel type, its source being connected to the positive terminal of battery 12, its drain being connected to the drain of n-channel type MOSFET Q8 and Q6's gate being connected to the source of MOSFET Q7 and to the source of n-channel type MOSFET Q13 to the gate of Q12 and to $\phi_{IN}$. The source and substrate of MOSFET Q8 is connected to the source and substrate of MOSFET Q9 and to the negative terminal of battery 14. The gate of MOSFET Q8 is connected to the drains of MOSFETS Q7 and Q9. The drain of MOSFET Q7 is connected to the gate of MOSFET Q8 and to the drain of MOSFET Q9. The gate of MOSFET Q9 is connected to the drains of MOSFETS Q6 and Q8.

$\phi_{IN}$ from high frequency dividers 20 is transferred from dividers 20 through level shifters 31 and 32 to the low frequency logic 22. Besides transferring the frequency from dividers 20 to dividers 22, the level shifters 31 and 32 extend the 1½ volts inputted on the $\phi_{IN}$ line to 3 volts on the $\phi_{OUT}$ line to be delivered to the low frequency logic 22.

The MOSFETS of level shifter 32 (Q10–Q13) are connected in the same manner as the MOSFETS of level shifter 31.

The A.M./P.M. signal on input line 22 is connected to a first input to NOR gate 34 and thru inverter 38 to a first input to NOR gate 40. The output of NOR gate 34 is connected to the gate of n-channel type MOSFET Q4 and thru inverter 36 to the gate of n-channel type MOSFET Q5. The gates of MOSFETS Q3 and Q6 are connected. The drains of MOSFET Q4 and MOSFET Q5 are connected together and to output 18. The source of Q5 is connected to the negative terminal of battery 14. The source of Q4 is connected to the source of Q3 which is used to provide the proper substrate bias for MOSFET Q4.

The pushbutton input to the battery select circuitry is connected to a second input to NOR gate 34 and to a second input to NOR gate 40. The output of NOR gate 40 is connected to the gates of p-channel type material MOSFET Q1 and n-channel type material MOSFET Q2. The source of Q1 is connected to the positive terminal of battery 12. The drain of Q1 is connected to the drain of Q2 and to output 16. The source of Q2 is connected to the common and to the source of Q3 and Q4.

THE OPERATION

A n-channel type MOSFET conducts when a high binary level signal is present at its gate and a p-channel type MOSFET conducts when a low binary level signal is present at its gate.

When a high binary level signal is present on input 22 (either signifying the A.M. or the P.M. period) the output of NOR gate 34 is at a low binary level so that Q4 is not conducting, the output of inverter 36 is at a high binary level so that Q5 conducts, thereby outputting the negative voltage from battery 14 onto output 18. Also, when there is a high level signal on input 22 the output of inverter 38 is at a low binary level therefore the output of NOR gate 40 is at a high level; allowing Q2 to conduct the common signal to output 16. Therefore, when input 22 is high, battery 14 delivers its 1½ volts across outputs 16 and 18.

When input 22 is at a low binary level the output of NOR gate 34 is high, so Q4 conducts, thereby outputting the common signal on output 18. The output of inverter 36 is low so Q5 is not conducting. The output of inverter 38 is high when there is a low signal on input 22 so that the output of NOR gate 40 is at a low binary level, therefore Q1 conducts thereby delivering the positive signal to output 16. Therefore, when input 22 is low, battery 12 delivers its 1½ volts between outputs 16 and 18.

To summarize, when a high binary level signal is present at input 22, (e.g., the A.M. period is present), the 1½ volts of battery 14 is being delivered on outputs 16 and 18 to the digital watch's oscillator and high frequency dividers 20. And when a low binary level signal is present on input 22, (e.g., the P.M. period is present), the 1½ volts of battery 12 is being delivered via outputs 16 and 18 to the digital watch's oscillator and high frequency dividers 20.

When the digital watch user depresses the watch's push button, thereby delivering a high binary level signal on the P/B input line, the output of NOR gate 34 is low so that Q4 does not conduct and the output of inverter 36 is high so Q5 does conduct thereby delivering the negative signal to output 18. The output of NOR gate 40 is low so Q1 conducts and the positive signal is delivered to output 16. Therefore, when the push button is depressed batteries 12 and 14 deliver their combined voltage (3 volts) between outputs 16 and 18.

Level shifters 31 and 32 take the frequency $\phi_{IN}$ from the high frequency dividers 20 and transfer it via $\phi_{OUT}$ to the low frequency logic 22. The level shifters 31 and 32 take the 1½ volts delivered from the high frequency dividers 20 via line $\phi_{IN}$ and shift or extend the voltage to 3 volts which is delivered via $\phi_{OUT}$ to the low frequency logic 22.

Figure 3:
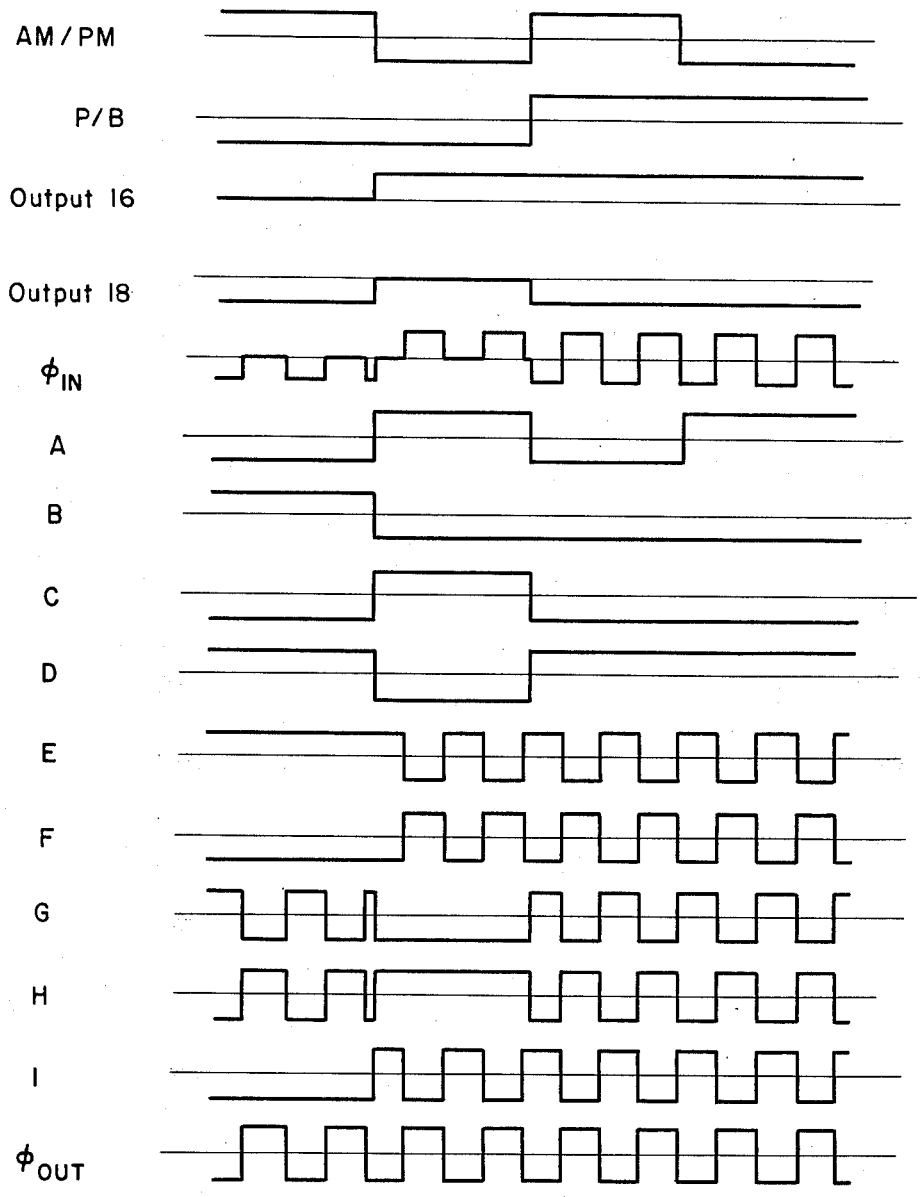
FIG. 3 shows the waveforms associated with the battery select circuitry and level translator.

FIG. 3 shows various waveforms associated with the battery select circuitry and level translator 30. The first waveform shows the A.M./P.M. signal. When the digital watch is in the A.M. period the waveform is high and when the watch is in the P.M. period or time mode the waveform is at a low binary level. The second waveform shows the pushbutton signal. When the push button is unactivated or not depressed the signal is in a low binary level and when the push button is depressed to obtain the horological information on the display devices the waveform is at a high binary level. The next two waveforms show the signals present on the battery select circuitry outputs 16 and 18. Only 1½ volts is present between these outputs until the push button is depressed, at which time 3 volts appears between outputs 16 and 18. The subsequent waveforms, A-I, show various signals present at particular points in the battery select circuitry and the level translator.

In summary, the battery select circuitry and level translator 30 of the present invention connects a first battery 14 to the digital watch's oscillator and high frequency dividers 20 to power same during the A.M. period and then connects a second battery 12 between outputs 16 and 18 to power the digital watch's oscillator and high frequency dividers 20 during the P.M. period. This invention greatly saves the battery life of the two batteries 12 and 14 by using substantially only one of the batteries for the majority of the time until the 3 volts of both batteries is needed to activate the display devices and by the switching of the two batteries every twelve hours so that the battery power of the two batteries is dissipated at an equal rate. Also, the level translator extends the 1½ volts from the high frequency dividers 20 to the necessary 3 volts to clock the low frequency logic 22.

Although the device which has just been described appears to afford the greatest advantages for implementing the invention, it will be understood that various modifications may be made thereto without going beyond the scope of the invention, it being possible to replace certain elements by other elements capable of fulfilling the same technical functions therein.

What is claimed is:

1. A method for increasing the battery life of the batteries in a digital watch with batteries, an oscillator, high frequency dividers and display devices which comprises:

a. connecting only one of first and second batteries to power the digital watch's oscillator and high frequency dividers when the watch's display elements are not activated;

b. connecting said first and second series connected batteries to both power the digital watch's oscillator, high frequency dividers and display devices when the watch's display elements are activated;

c. switching said batteries at predetermined time periods, thereby connecting said first battery to the digital watch's oscillator and high frequency dividers during one time period and then connecting said second battery to the digital watch's oscillator and high frequency dividers during another substantially equal time period.

2. A method for increasing the battery life of the batteries in a digital watch with batteries, an oscillator, high frequency dividers, low frequency logic and display devices which comprises:

a. connecting only one of the first and second batteries to power the digital watch's oscillator and high frequency dividers when the watch's display elements are not activated;

b. connecting said first and second series connected batteries to both power the digital watch's oscillator, high frequency dividers and display devices when the watch's display elements are activated;

c. switching said batteries at predetermined time periods, thereby connecting said first battery to the digital watch's oscillator and high frequency dividers during one time period and then connecting said second battery to the digital watch's oscillator and high frequency dividers during another substantially equal time period;

d. increasing the voltage from said high frequency dividers to a greater voltage level to clock said low frequency logic.

3. An improved digital watch of the type having an oscillator connected to high frequency dividers, low frequency watch logic, and a push button for activating display devices, wherein the improvement comprises:

a first battery for powering said oscillator and high frequency dividers;

a second battery for powering said oscillator and high frequency dividers;

a battery select circuit comprising a plurality of logic gates connected between said batteries and said oscillator and high frequency dividers for connecting said first battery to said oscillator and high frequency dividers during the first time period and for connecting said second battery to said oscillator and high frequency dividers during the second time period;

a first and second level shifter connected between said batteries and said low frequency watch logic for transferring the frequency from said high frequency dividers to said low frequency watch logic and for increasing the voltage from said high frequency dividers to a higher voltage level to clock said low frequency watch logic;

a plurality of push buttons for causing said display devices to display the horological information.

4. A digital watch as recited in claim 3, wherein said logic gates and level shifters consist of MOSFETS.

5. A digital watch as recited in claim 3, wherein said first time period is the A.M. time period and said second time period is the P.M. time period.

* * * * *